US005154312A

United States Patent [19]

Robbins

[11] Patent Number: 5,154,312

[45] Date of Patent: Oct. 13, 1992

[54] TANK SECONDARY CONTAINMENT SYSTEM

[76] Inventor: Howard J. Robbins, 8561 El Paseo Grande, La Jolla, Calif. 92037

[21] Appl. No.: 340,802

[22] Filed: Apr. 20, 1989

Related U.S. Application Data

[62] Division of Ser. No. 94,584, Sep. 9, 1987.

[51] Int. Cl.[5] ..... B65D 8/22

[52] U.S. Cl. ..... 220/724; 220/86.1

[58] Field of Search ..... 220/85-89, 220/724-727, 86.1

[56] References Cited

U.S. PATENT DOCUMENTS

| | | | |
|---|---|---|---|
| 1,156,469 | 10/1915 | Dodge | 220/85 S |
| 1,424,037 | 7/1922 | Rudolph | 220/86.1 |
| 1,669,022 | 5/1928 | Root, Jr. | 220/86.1 |
| 1,935,044 | 11/1933 | Davis, Jr. | 220/86.1 |
| 1,973,652 | 9/1934 | Parsons | 220/86.1 |
| 2,102,912 | 12/1937 | Pittman | 220/85 S |
| 2,155,179 | 4/1939 | Buttner et al. | 220/86.1 |
| 2,204,329 | 6/1940 | Tennant | 220/85 S |
| 2,673,010 | 3/1954 | Barrow | 220/86.1 |
| 3,250,420 | 5/1966 | Kohn | 220/86.1 |
| 3,963,144 | 6/1976 | Berwald | 220/728 |
| 4,114,783 | 9/1978 | Wempe et al. | 220/85 S |
| 4,478,345 | 10/1984 | Edwinger | 220/724 |
| 4,629,087 | 12/1986 | Lenz | 220/85 S |
| 4,796,676 | 1/1989 | Hendershot et al. | 220/723 |

FOREIGN PATENT DOCUMENTS

| | | | |
|---|---|---|---|
| 2,365,941 | 1/1977 | Fed. Rep. of Germany | 220/86.1 |

*Primary Examiner*—Joseph Man-Fu Moy
*Attorney, Agent, or Firm*—Albert L. Gabriel

[57] ABSTRACT

Tank secondary containment system, principally for underground fluid storage tanks such as for fuel storage, which is applicable to both single wall tanks and double wall tanks for providing secondary, double wall fluid containment in the regions of access pipe fittings and pipe connections, which are the places most prone to failure. For double wall tanks, the invention completes the secondary containment which is conventionally only partially afforded by double wall tank construction. Access fittings at the top of the tank and at least lower portions of their respective function pipes which extend to surface equipment are surrounded by tubular secondary containment covering, the lower portion of which is preferably a riser, which is bonded and sealed to the outside of the tank for either a single or double wall tank, and for a double wall tank may extend through an aperture in the outer wall down to the inner wall. If desired, the secondary containment covering may extend coextensively with the function piping to surface equipment.

20 Claims, 5 Drawing Sheets

TANK SECONDARY CONTAINMENT SYSTEM

This application is a division of application Ser. No. 07/094,584, filed Sep. 9, 1987, still pending.

BACKGROUND OF THE INVENTION

1. Field of the Invention

The present invention is in the field of tanks, principally for underground fluid storage such as fuel storage, and is particularly directed to secondary fluid containment to protect against leakage in the region of tank pipe fittings and connections.

2. Description of the Prior Art

Regulations in many states and of the U.S. federal government currently require double wall construction for underground fluid storage tanks such as fuel storage tanks, in order to provide secondary fluid containment because of environmental considerations. Such double wall tank construction constitutes, in effect, an inner tank supported within an outer tank. The inner tank defines the primary, inner chamber which provides primary containment for fluid being stored, while the space defined between the inner and outer tanks defines a secondary chamber which provides for secondary containment of the fluid in the event a leak should develop through the wall of the inner tank, as for example from corrosion, a faulty weld, or seismic or other mechanical stressing. One or more fluid-sensing monitors are conventionally located in communication with one or more low zones in the secondary chamber between the two tanks, and any leakage from the inner, primary tank chamber into the secondary chamber is directed toward one or more of such monitors which then provide an alarm signal indicating the leakage.

There are several different grades and types of underground storage tanks generally considered in the art to be of double wall construction which are currently in use in the United States, and these are almost all of cylindrical construction and adapted to be layed on their sides underground, i.e., have their cylindrical axes disposed generally horizontally. A full double wall tank consisting of two complete cylindrical tanks, one inside the other, is designated a "double wall" tank. This type of tank has double end walls and 360° double cylindrical wall protection. Another type of tank which is not completely of double wall construction but is nevertheless commonly referred to as a double wall tank is known as a "wrap tank." In the wrap tank, the primary fluid holding tank is cylindrical, with an outer sheet provided which gives double wall protection for approximately 330° around the lower part of the tank, leaving the top part of the tank with only the single wall protection of the primary tank. The wrap tank is utilized with the consideration that the greatest potential for failure of the primary tank is in its lower part, with a relatively small potential for failure at its top. While regulations of some states still allow use of the wrap tank as a double wall tank, other, more progressive states such as California require the full double wall tank.

Underground storage tanks for hazardous and flammable materials such as fuels require access pipe fittings which extend through the top of the tank from the outside into the primary containment chamber within the tank, and most of such fittings have function pipes connected thereto which extend upwardly to surface equipment. Typically for the storage of fuels such as gasoline and diesel fuel, there are at least five such function fittings required, including a fill fitting, a turbine fitting for fluid extraction, a fitting for gauging, a vent fitting, and a vapor recovery fitting.

In a full double wall metal tank, these pipe fittings conventionally extend through both walls at the top of the tank, being welded or otherwise bonded to both the outer and inner tanks. While this arrangement technically has full double wall protection at the fittings, in practice it has the serious disadvantage that the connections of function pipes to the fittings, as well as the lengths of such pipes and pipe joints therein, conventionally have only single wall protection, and therefore do not fulfill the intent and spirit of current governmental regulations requiring double wall containment. Such conventional pipe fittings in full double wall metal tanks have the further disadvantage that the welds joining the fittings to the inner tank must either be made from the inside of the inner tank or through an oversize access hole in the outer tank which then must be filled.

Wrap tanks are metal tanks, and for such tanks the pipe fittings are conveniently welded into the single wall at the top of the tank. This, of course, provides only single wall containment at the fittings, and again, there is only single wall containment where function pipes are connected to the fittings and along the lengths of such pipes. Accordingly, such wrap tanks are even further away than the full double wall tanks from complying with the intent and spirit of current governmental regulations.

Many tanks currently being produced and sold as full double wall tanks are nonmetallic, as for example having a wound filament fiberglass/resin construction. The filament winding fabrication process does not permit fittings to be integrally incorporated in such a double wall nonmetallic tank when the two walls are being fabricated, and if the fittings were to be disposed directly through the two walls of the nonmetallic double wall tank, then it would be necessary to drill holes through the two walls and bond the fittings to the walls from both the inside and outside, which would be costly, difficult and unreliable. Therefore, for nonmetallic double wall tanks the almost universal current procedure is to provide manway openings, and to provide metal covers for such openings through which the pipe fittings are welded. Normally only three fittings can be accommodated in a single manway cover, so that where more than three fittings are required, which is usually the case, two manways and associated metal covers with fittings are conventionally provided with double wall nonmetallic tanks. Such metal manway covers with fittings for nonmetallic tanks are conventionally of single wall construction, lacking any double wall containment at the fittings, and again, lacking any double wall containment where function pipes connect to the fittings or along the lengths of such pipes.

Applicant's U.S. Pat. No. 4,685,585, issued Aug. 11, 1987, teaches the incorporation of pipe fittings with a pair of spaced covers of a double wall manway system. While this affords true double wall containment in the manway and at the fittings, it again does not provide double wall containment where function pipes connect to the fittings, or along the lengths of such pipes.

Thus, despite current governmental regulations requiring double wall containment for underground tanks, many so-called double wall tanks currently actually provide only single wall protection at pipe fittings and along the lengths of pipes connected to the fittings, and applicant is not aware of any prior art system which provides true double wall containment for all regions associated with a double wall tank, including the pipe fittings per se, connections of function pipes to the pipe fittings, and along the lengths of such pipes extending to surface equipment.

There are currently strong indications from the EPA (U.S. Environmental Protection Agency) and other regulatory agencies that statistically, in the field, for underground tanks which are properly installed, whether double wall or single wall, the failures which occur are at the connections to the tanks and not in the tanks themselves.

SUMMARY OF THE INVENTION

In view of these and other problems in the art, it is an object of the present invention to provide a tank secondary fluid containment system which provides complete secondary or double wall protection for access pipe fittings on the tank.

Another object of the invention is to provide a tank secondary fluid containment system which is equally applicable to both double wall tanks and single wall tanks for providing secondary or double wall protection for access pipe fittings and pipe connections on the tank.

Another object of the invention is to provide a secondary fluid containment system for double or single wall tanks which is capable of providing secondary or double wall containment for function pipes along substantially their entire lengths, from their connections to access pipe fittings of the tank all of the way upwardly to surface equipment.

Another object of the invention is to provide a secondary fluid containment system which will complete the double wall containment of an otherwise full double wall tank, in the region of access pipe fittings of the tank and pipe connections to such fittings.

Another object of the invention is to provide a secondary fluid containment system for the pipe fittings and pipes associated with a double wall tank which is equally applicable to double wall tanks of both metal construction and fiberglass/resin or other nonmetallic construction.

Another object of the invention is to provide a tank secondary fluid containment system for the pipe fittings and pipes of a tank which permits convenient worker access for servicing of apparatus such as a turbine pump motor located above one of the fittings.

A further object of the invention is to provide a secondary fluid containment system for double wall tanks wherein part of the secondary containment is provided within a large, generally tubular riser of any desired cross-sectional configuration extending upwardly from the tank and which can have a containment lid at its top, this type of secondary containment enabling the lower end portions of function pipes to remain uncovered within the secondary containment riser and where they connect to the tank pipe fittings, whereby convenient servicing access is enabled through the riser for servicing the pipes, pipe fittings and associated equipment.

A further object of the invention is to provide a tank secondary fluid containment system which has shroud or cover means extending collectively over a plurality of the tank pipe fittings that are generally grouped together, so as to define a collective secondary containment space within which the pipe fittings and their respective function pipe connections are located; with individual secondary containment tubes extending from this collective shroud or cover means over lower end portions of the respective function pipes, and if desired extending generally coextensively with the function pipes, to provide individual secondary containment spaces about the function pipes.

A further object of the invention is to provide a tank secondary fluid containment system for providing complete secondary double wall containment in the region of a plurality of the tank pipe fittings, which is elongated and arranged longitudinally along the top of the tank, providing secondary containment for a generally longitudinal array of any desired number of access pipe fittings, as for example at least five pipe fittings for accommodating a fill function, a turbine extraction function, a gauging function, a vent function, a vapor recovery function, and others if desired.

A further object of the invention is to provide a tank secondary fluid containment system which has shroud or cover means extending individually over each of the tank pipe fittings and at least the lower end portion of its respective function pipe proximate its connection to the fitting, so as to define secondary containment space extending from around the pipe fitting and around at least a lower end portion of the respective function pipe, and if desired generally coextensively along the length of the respective function pipe.

A still further object of the invention is to provide a secondary fluid containment system for double wall tanks which, if desired, enables pipe access fittings for function pipes to be connected only to the inner of the two tank walls, without the conventional requirement of fittings being connected to both the inner and outer tank walls, thereby substantially simplifying installation of access pipe fittings and enabling them to be welded entirely from outside of the tank.

A still further object of the invention is to provide a secondary fluid containment system for double wall tanks wherein all welds and/or resin bonds required for access pipe fittings and for the secondary containment structure itself can be conveniently effected from outside of the tank, thereby substantially simplifying construction.

A further object of the invention is to provide a secondary fluid containment system for double wall tanks wherein a secondary containment riser may extend down through an aperture in the outer tank wall to the inner tank wall and be connected and sealed to both the outer and inner tank walls, with one or a plurality of pipe access fittings and respective function pipes isolated by the riser from the space between the concentric tank walls, and with the riser providing the lower portion of the secondary fluid containment system.

Yet a further object of the invention is to provide a secondary fluid containment system for double or single wall tanks which can be conveniently fabricated, at least in part, of plastic materials such as fiberglass reinforced resin, even for metal tanks including double wall metal tanks, enabling installation and sealing to be easily accomplished by the use of resin bonding materials.

The system of the present invention provides complete secondary, double wall fluid containment for either single wall tanks or double wall tanks in the regions of access fittings and pipe connections to the fittings, which are the places most prone to failure. For double wall tanks, the invention completes the secondary fluid containment which is conventionally only partially afforded to underground fluid storage tanks by double wall tank construction.

According to the invention, one or more of the tank access fittings located at the top of the tank, and preferably an array of a plurality of these tank fittings, are surrounded or encompassed by a tubular cover or shroud which is bonded and sealed to the outside of the tank for either a single or double wall tank, and for a double wall tank the cover or shroud may be bonded to both the outer and inner tank walls. The lower portion of this cover or shroud is preferably in the form of a riser. In some forms of the invention, the riser is of generally circular cylindrical configuration and surrounds an array of a plurality of the pipe fittings; while in other forms of the invention, the riser is of elongated configuration as for example rectangular in cross-section, and surrounds an elongated array of the pipe fittings, which can be of any number, as for example at least five pipe fittings to accommodate the conventional five functions required for underground service station storage tanks. In one form of the invention, the secondary containment is applied individually to the pipe fittings with a circular cylindrical riser surrounding each of the protected pipe fittings.

In a first form of the invention disclosed herein, a generally horizontal plate extends across the inside of the riser, being peripherally attached and sealed to the riser so as to provide a secondary containment space under the plate between the plate and the tank wall exposed within the riser. When this form of the invention is applied to a double wall tank in the manner illustrated herein, the riser may extend down through an aperture in the outer wall to the inner wall, being bonded to both walls, so the secondary containment space under the plate will be between the plate and the inner tank wall. However, if this form of the invention is applied alternatively to the outer wall of a double wall tank as described hereinafter, or is applied to a single wall tank, then this secondary containment space under the plate will be between the plate and the outer wall or outside of the tank. In this form of the invention, large apertures through the riser plate are aligned or register with the respective access pipe fittings, and secondary containment tubes are attached and sealed to the plate at these apertures. Function pipes connected to the respective fittings extend upwardly within these secondary containment tubes, and the secondary containment tubes extend upwardly in surrounding relationship about at least lower portions of the function pipes proximate their connections to the fittings, and if required, all the way to surface equipment, with secondary containment spaces extending longitudinally between the tubes and function pipes.

In a second form of the invention disclosed herein, the secondary containment plate of the first form is omitted and is replaced by a high secondary riser, which may be of fiberglass reinforced resin, which seats within the primary riser previously described and is peripherally sealed thereto. Function pipes extending upwardly from the respective access pipe fittings extend through respective large apertures in the wall of the secondary riser, and secondary containment tubes extend from the wall of the secondary riser at these apertures in surrounding relationship over the respective function pipes, the secondary containment tubes extending upwardly in surrounding relationship about the function pipes as far as desired. The large secondary riser may have a removable lid which normally seals off the secondary containment space within the secondary riser, but is removable for convenient access to equipment that may be located above the tank within the secondary riser, such as turbine pump equipment which is likely to require servicing.

Both circular and elongated configurations of the invention are shown and described herein, and each of these configurations may employ the secondary containment plate which spans the inside of the primary riser or may employ the large secondary riser. Additionally, one form of the invention shown and described herein combines an elongated riser for an elongated array of pipe fittings and respective function pipes, with a circular primary riser and large secondary riser which cover one of the pipe fittings such as a turbine fitting having equipment which is likely to require servicing.

In the form of the invention having a single riser for each pipe fitting and respective function pipe, a secondary containment tube connects directly to each riser and extends longitudinally about the respective function pipe as far as required, which may be only a lower portion of the pipe, or may be to surface equipment.

In each form of the invention shown and described in detail herein, one or more fluid sensors can be mounted within each fluid containment space so as to sense a lowermost region therein which is closely proximate the inner tank wall. By this means, any fluid escaping anywhere within the secondary containment system will drain down to such lowermost region and be sensed by the one or more sensors, the sensed information being transmitted to surface equipment.

DETAILED DESCRIPTION

Figure 6:
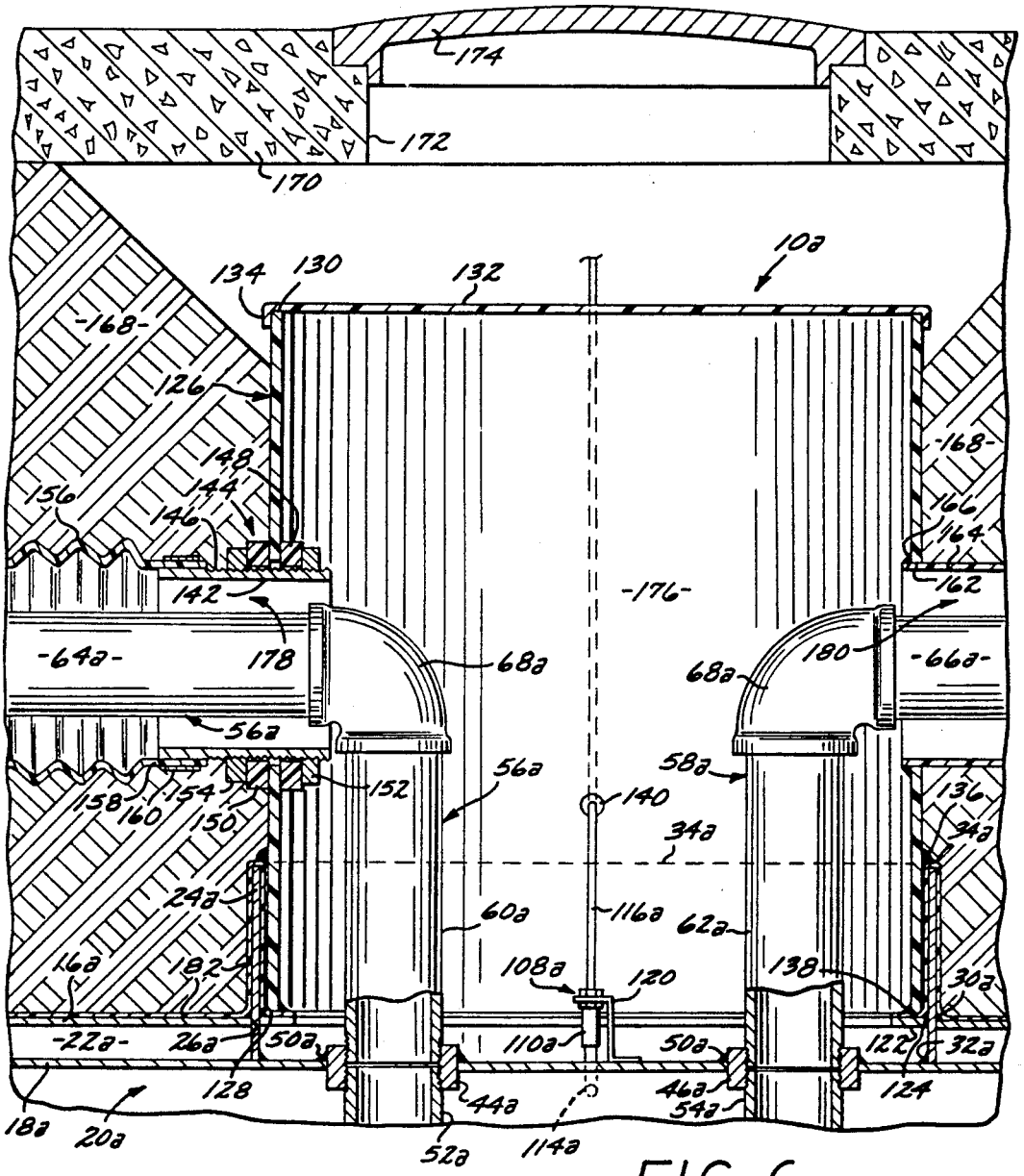
FIG. 6 is a vertical sectional view similar to FIG. 3, but looking in the opposite direction from the 3—3 arrows of FIG. 2, illustrating a second form of the invention which embodies a large secondary riser.
Figure 5:
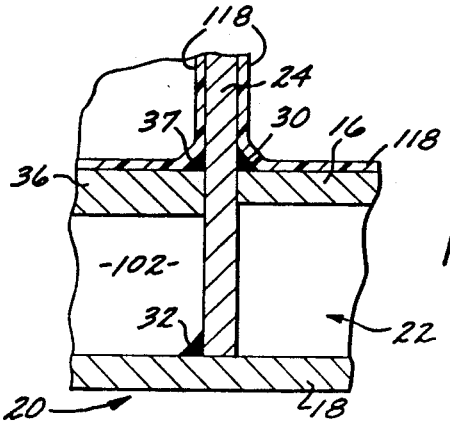
FIG. 5 is an enlarged fragmentary sectional view taken in the encircled region of FIG. 3 designated 5.

Although the present invention is equally applicable to both single wall tanks and double wall tanks, each of the several forms of the present invention illustrated in the drawings provides secondary or double wall containment for all of the pipe fittings and associated pipes which communicate from the outside to the inner, primary chamber of a double wall underground fluid storage tank. For an underground fuel storage tank, typically as many as five tank pipe fittings are required: a fill fitting, a turbine fitting for fluid extraction, a fitting for gauging, a vapor recovery fitting, and a vent fitting. Such fittings are conventionally of relatively large diameter, having 4-inch diameter internal threads for accommodating 4-inch OD piping. Although the forms of the invention illustrated in FIGS. 1-5 and in FIG. 6 are shown as having three such fittings and the forms shown in FIGS 7-10 and 11-12 are shown as having five such fittings, it is to be understood that any desired number of fittings may be employed which can be conveniently disposed within the confines of the risers utilized in the various forms of the invention.

While the double wall tanks illustrated in the drawings are shown to be metal tanks, it is to be understood that the present invention is equally applicable to conventional nonmetallic double wall tanks.

FIGS. 1-5 illustrate a first form of the invention which provides access for three pipelines from the outside of a double wall tank to the inner, primary chamber of the tank, with full secondary, double wall containment for the pipelines and tank fittings. However, for convenience of illustration, only two pipelines are illustrated in FIGS. 1-5, and the third access fitting is shown plugged and sealed.

The secondary containment system of the invention shown in FIGS. 1-5 is generally designated 10, and is embodied in the top of a double wall tank generally designated 12, conventionally of cylindrical configuration, which is adapted to be layed on its side underground, i.e., with its cylindrical axis disposed generally horizontally. Double wall tank 12 has cylindrical body 14 and end closures 15. Double wall tank 12 actually consists of an outer tank and an inner tank which is closely spaced within the outer tank, with a double, parallel wall construction in both the cylindrical body 14 and the end closures 15. The outer tank cylindrical wall is designated 16, and the inner tank cylindrical wall is designated 18. The inner cylindrical wall 18 of tank 12 defines the inner or primary chamber 22 of tank 12, while the space between outer and inner cylindrical walls 16 and 18, respectively, constitutes an outer peripheral or secondary chamber 22 of tank 12. One or more monitor sensors (not shown) are provided in a conventional manner in a bottom zone of the outer, secondary chamber 22 so that any leak from the inner, primary chamber 20 through inner wall 18 or the inner wall part of an end closure 15 will be detected by such monitor or monitors.

A cylindrical riser is conventionally provided on tanks for providing a sump within which pipe fittings are contained. Such cylindrical risers are conventionally attached to only the outer wall of a double wall tank, by welding for metal tanks, and extend upwardly from the outer tank wall. The secondary containment system 10 employs such a riser in a novel way. Here, cylindrical riser 24 extends down through a circular aperture 26 in outer cylindrical wall 16 and seats flush against the outer surface of inner cylindrical wall 18. The lower edge 28 of riser 24 is arcuately scalloped to enable such flush seating against the outer surface of inner cylindrical wall 18. The outer cylindrical surface of riser 24 is bonded about its entire periphery to the outside of outer cylindrical wall 16, as by a weld 30, while the inner cylindrical surface of riser 24 adjacent its lower edge 28 is bonded about its entire periphery to the outside of inner cylindrical wall 18, as by a weld 32. The bonds 30 and 32 provide fluid-tight seals between riser 24 and outer and inner tank walls 16 and 18, respectively. It is to be understood that if the tank walls 16 and 18 were of nonmetallic construction, resin bonding and sealing material would be employed in place of welds 30 and 32. The top of riser 24 is defined by a flat annular upper edge 34.

A disk-shaped secondary containment plate 36 fits horizontally inside of riser 24, and it is peripherally bonded from above to the inner cylindrical surface of riser 24, as by an annular weld 37 which provides a fluid-tight seal between plate 36 and riser 24. Secondary containment plate 36 is preferably flat for fabrication convenience, but it could be curved, as for example contoured like outer tank wall 16.

Figure 1:
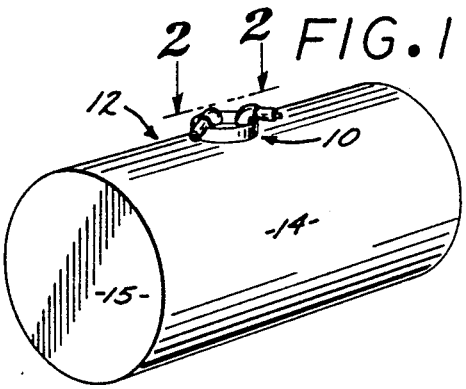
FIG. 1 is a perspective view showing a double wall underground fluid storage tank having a first form of the invention applied to the top thereof, this form of the invention being of the type having a circular riser which is spanned by a secondary containment plate.
Figure 2:
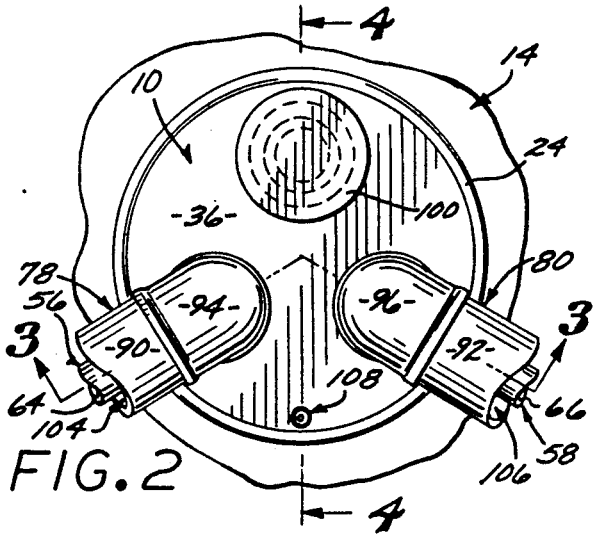
FIG. 2 is a fragmentary top plan view taken on the line 2—2 of FIG. 1.
Figure 3:
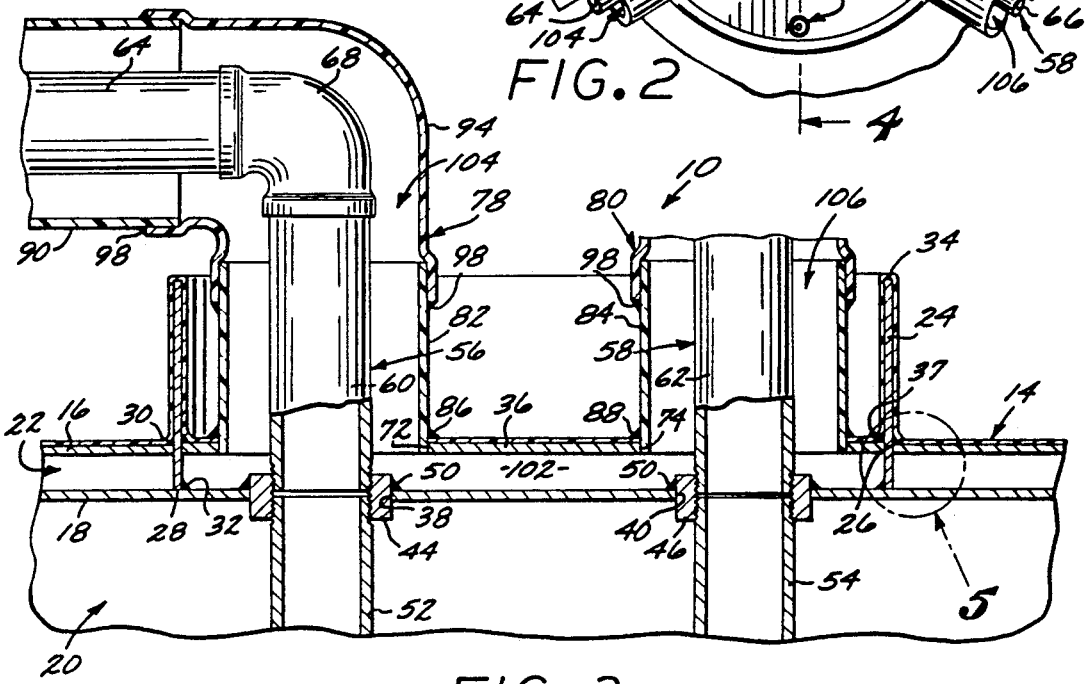
FIG. 3 is a fragmentary vertical sectional view taken on the radial line 3—3 in FIG 2 showing details of construction of the form of the invention shown in FIGS. 1 and 2.
Figure 4:
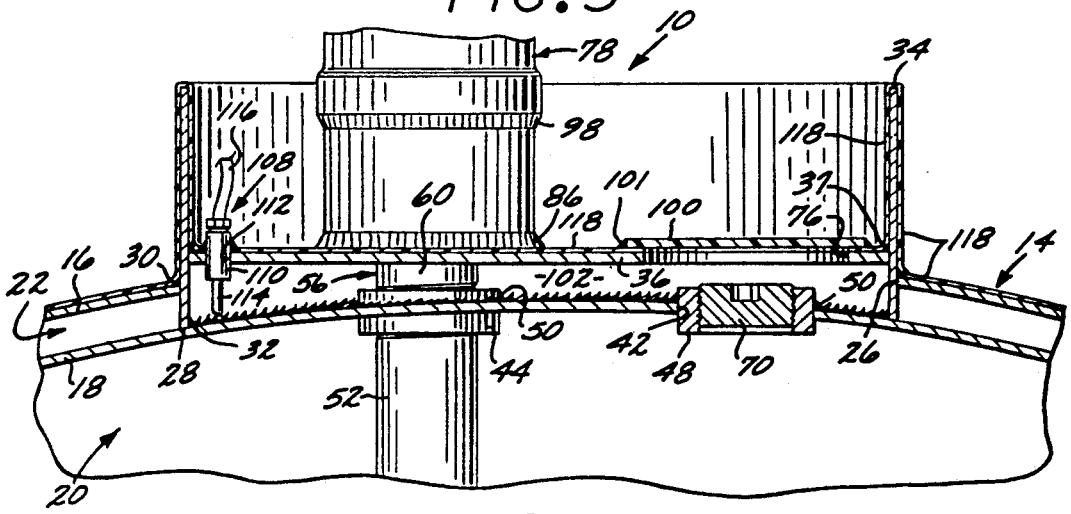
FIG. 4 is a vertical section taken on the diametral line 4—4 in FIG. 2 showing further details of construction of the form of the invention shown in FIGS. 1–3.

A circular array of three regularly spaced holes 38, 40 and 42 is cut through the inner cylindrical wall 18 of tank 12 to receive three respective pipe fittings 44, 46 and 48 which are secured and sealed in place, as by respective welds 50. Riser 24 is generally concentric about this array of pipe fittings, generally registering with but being somewhat larger in diameter than the array of pipe fittings. Pipe fittings 44, 46 and 48 are internally threaded, and typically will have a 4-inch ID, although other sizes may be employed. Two of the three pipe fittings, 44 and 46, are shown to be in use, and the third pipe fitting, 48, is shown plugged. Thus, downwardly extending pipes 52 and 54 are shown threadedly engaged in respective pipe fittings 44 and 46. The secondary containment system of FIGS. 1–5 is shown applied to the pipe fittings 44 and 46 and to a pair of upwardly extending pipes generally designated 56 and 58 which are also threadedly connected into the respective pipe fittings 44 and 46. Pipes 56 and 58 will normally extend to surface equipment for two of the several functions referred to above. Typically, pipes 56 and 58 will extend in different directions from within riser 24 as illustrated in FIGS. 2 and 3. For this purpose, pipes 56 and 58 include respective upwardly extending sections 60 and 62, respective horizontally extending sections 64 and 66, and respective elbow sections 68 which connect upwardly extending section 60 with horizontally extending section 64, and upwardly extending section 62 with horizontally extending section 66. The third pipe fitting 48 is seen in FIG. 3, and is sealed off with a threaded plug 70.

Secondary containment plate 36 has three large, regularly spaced apertures 72, 74 and 76 extending therethrough which are axially aligned or generally register with the respective pipe fittings 44, 46 and 48, being considerably larger in diameter than the pipes adapted to be accommodated by pipe fittings 44, 46 and 48. Thus, where pipe fittings 44, 46 and 48 are typical 4-inch pipe fittings, the apertures 72, 74 and 76 through secondary containment plate 36 will typically be about 6–10 inches in diameter. Each of the function pipes which extends upwardly from a respective pipe fitting extends upwardly through a respective one of the large apertures 72, 74 and 76, and is surrounded by a respective secondary containment tube which extends upwardly from plate 36 at a respective one of the large apertures 72, 74 and 76. Thus, a large secondary containment tube 78 is connected to plate 36 coaxially of aperture 72 and coaxially surrounds the upwardly extending pipe 56; while a large secondary containment tube 80 is attached to plate 36 coaxially of aperture 74 and coaxially surrounds the upwardly pipe 58. For convenience of installation, these secondary containment tubes 78 and 80 are shown assembled from sections, including respective upwardly extending sections 82 and 84, the lower ends of which seat within respective apertures 72 and 74 which are bonded to plate 36 by respective annular attachment seals 86 and 88 of a suitable resin bonding material. The upwardly extending sections 82 and 84 surround respective pipe sections 60 and 62. The assemblies of tubes 78 and 80 also include respective horizontally extending sections 90 and 92 which surround respective pipe sections 64 and 66, and respective elbow sections 94 and 96 which surround respective elbow sections 68 of pipes 56 and 58. The connections between the sections of each of the secondary containment tubes 78 and 89 are provided with fluid-tight seals 98.

Secondary containment tubes 78 and 80 may be of fiberglass reinforced resin construction for light weight and convenience in handling. Although secondary containment tubes 78 and 80 are shown as being generally rigid, it is to be understood that they may alternatively be flexible, and if desired, may be of bellows construction as shown for one of the alternative secondary containment embodiments illustrated in FIG. 6. Secondary containment tubes 78 and 80 may be coextensive with the lengths of respective pipes 56 and 58 that would otherwise be exposed, surrounding the respective pipes 56 and 58 all of the way to the upper, service ends of pipes 56 and 58 which may be located above ground. Alternatively, one or more of the secondary containment tubes may only cover lower end portions of their respective function pipes where connections would be most likely to fail.

The large aperture 76 in plate 36 which is coaxially above the pipe fitting 48 sealed by plug 70 is closed off by a cover disk 100, which may also be of fiberglass reinforced resin construction. Cover disk 100 is sealed to plate 36 by an annular seal 101 which completes the secondary containment.

It will be seen that with the tank secondary containment system 10 of FIGS. 1–5, every point in the primary fluid system that might be vulnerable to leakage from corrosion, poor welding, poor sealing, or earth movement stresses such as those seismically induced, is completely covered by secondary containment. Thus, the inner, primary chamber 20 of tank 12, defined in part by inner cylindrical wall 18, is completely covered by an outer wall which includes outer cylindrical wall 16, except in the region defined within cylindrical riser 24. Within riser 24, inner cylindrical wall 18 has primary seals in the form of pipe fittings 44, 46 and 48, and pipes 56 and 58 and plug 70. In the region of riser 24, inner cylindrical wall 18 is completely enclosed by secondary containment afforded by secondary containment plate 36, secondary containment tubes 78 and 80, and cover disk 100. Similarly, primary containment pipes 56 and 58 are provided with complete secondary containment coverage by secondary containment plate 36 at their bases, and along as much of their lengths as desired by secondary containment tubes 78 and 80. Thus, the secondary containment spaces are the relatively flat, circular space 102 defined within the bottom portion of riser 24 between inner tank wall 18 and secondary containment plate 36 and cover disk 100; and generally annular secondary containment spaces 104 and 106 respectively between pipe 56 and secondary containment tube 78 on the one hand, and pipe 58 and secondary containment tube 80 on the other hand. Any leakage from inner, primary chamber 20 of tank 10 in the region of riser 24 will be contained within secondary containment space 102; while any leakage from pipes 56 and 58 will be received in secondary containment spaces 104 or 106 and will drain down into secondary containment space 102.

While it is preferred that the IDs of secondary containment tubes 78 and 80 be substantially larger than the ODs of the respective pipes 56 and 58 and that tubes 78 and 80 be generally coaxially arranged about the respective pipes 56 and 58, the important thing is to have the IDs of tubes 78 and 80 sufficiently larger than the ODs of the respective pipes 56 and 58 to provide flow space so that leakage from either of the pipes 56 or 58 will be conducted down through the respective tube 78 or 80 into the secondary containment space 102 where it can be sensed.

A sensor generally designated 108 has a body 110 mounted in a small aperture 112 through plate 36, with suitable fluid-tight sealing. Sensor 108 has a probe 114 which extends down into a low point in secondary containment space 102 provided by the transverse curvature of inner tank wall 18. Sensor 108 has an output cable 116, shown broken off within riser 24 in FIG. 4, which leads to surface readout equipment. Sensor 108 may be of any type well known in the art which is adapted to sense the presence of liquids such as hydrocarbon fuels contained in tank 10, or their fluid vapors, or water, or other fluids. If desired, a plurality of sensors like sensor 108 may be employed. For example, a second sensor 108 may be provided in the other side of secondary containment space 102 so that both of the lowermost regions in space 102 can be sensed.

Preferably, a fiberglass-reinforced resin coating 118 is applied as a corrosion deterrent over the entire outside of tank 12, including the outside of outer cylindrical wall 16, the outer and inner cylindrical surfaces and the upper edge 34 of riser 24, and the upper surface of secondary containment plate 36, the coating 118 also preferably welds 30 and 37. Tanks having such a fiberglass reinforced resin coating are manufactured and sold under the trademark "Plasteel" by Joor Manufacturing, Inc. of Escondido, Calif.

While the cylindrical riser of FIGS. 1-5 is shown extending substantially above the top of tank outer cylindrical wall 16, it is to be understood for the purpose of the present invention, the riser 24 need only extend upwardly to the level of secondary containment plate 36 to provide the complete double wall secondary containment described in detail hereinabove.

FIG. 6 illustrates a second basic form of tank secondary containment according to the invention, with two embodiments of this basic form being shown. The tank secondary containment system illustrated in FIG. 6 is generally designated 10*a*, and is embodied in the top of a tank similar to tank 12 shown in FIGS. 1-5. Thus, the tank of FIG. 6 has an outer cylindrical wall 16*a* and a concentric inner cylindrical wall 18*a* with double wall end closures like the closures 15 of tank 12. Inner cylindrical tank wall 18*a* defines inner, primary fluid chamber 20*a*, while the outer and inner walls 16 and 18*a*, respectively, define between them an outer, secondary fluid chamber 22*a* within which one or more conventional sensors are deployed.

A cylindrical riser 24*a* which, in this form of the invention, may be considered to be the primary riser, extends downwardly through a mating circular aperture 26*a* in outer cylindrical wall 16*a*, and is attached and sealed to the outer and inner cylindrical walls 16*a* and 18*a* in the same manner as riser 24 of the form of the invention shown in FIGS. 1-5, as by respective welds 30*a* and 32*a*. In the form of the invention shown in FIG. 6, it is desirable that riser 24*a* extend substantially above outer cylindrical wall 16*a* of tank 10*a* to an upper edge 34*a*, for mounting of the lower end portion of a second riser therein as described below.

Three pipe fittings are mounted in inner tank wall 18*a*, being regularly spaced within riser 24*a* in the same manner as the three pipe fittings in the first form of the invention shown in FIGS. 1-5. Two of these pipe fittings are illustrated in FIG. 6, fittings 44*a* and 46*a*. Downwardly extending pipes 52*a* and 54*a* are threadedly connected in respective fittings 44*a* and 46*a*. Upwardly extending function pipes generally designated 56*a* and 58*a* are threadedly connected in respective pipe fittings 44*a*and 46*a*, and include respective upwardly extending sections 60*a* and 62*a*, respective horizontally extending sections 64*a* and 66*a*, and respective elbow sections 68*a*.

Fluid sensor 108*a* has a body 110*a* which is mounted on a bracket 120 shown attached to inner cylindrical wall 18*a*. Sensor 108*a* includes a downwardly projecting probe 114*a* which extends downwardly into a lowermost portion of the region defined between inner tank wall 18*a* and cylindrical riser 24*a*. Thus, in the axial, vertical sectional view of FIG. 6, probe 114*a* is shown in the background below the sectioned center line of inner cylindrical wall 18*a*. In the transverse vertical section it would be located in substantially the same location as probe 114 of sensor 108 as it is illustrated in FIG. 3. Sensor 108*a* has output cable 116*a* which extends to surface readout equipment. A plurality of the sensors 108*a* may be employed.

A flat annular flange or ring 122 is horizontally mounted within cylindrical riser 24*a*, being bonded to riser 24*a* as by weld 124. A cylindrical secondary riser 126, which may be made of fiberglass reinforced resin, has its lower end portion nested within primary riser 24*a*, and extends a considerable distance above primary riser 24*a*. A suitable axial length or height for secondary riser 126 is approximately three feet, while a suitable outer diameter for secondary riser 126 ranges from about 24 inches to about 48 inches. This provides adequate height for the secondary containment apparatus described below, and ample width for servicing of equipment encompassed within risers 24*a* and 126. An example of equipment which sometimes requires servicing that is generally located immediately above the tank is the motor part of a turbine pump for extracting fuel from the tank. For a secondary riser 126 having an OD of approximately 40 inches, a primary riser 24*a* having an OD of approximately 42 inches will be adequate to receive the lower end portion of secondary riser 126. The lower edge 128 of secondary riser 126 is a flat annular edge which rests on the upper surface of flange 122. The upper edge 130 of secondary riser 126 is also a flat annular edge, and provides seating for a disk-shaped removable lied 132 which may be provided if desired, the lid 132 having a down-turned peripheral flange 134 that is in sealing engagement with the outer peripheral surface of secondary riser 126 proximate upper edge 130. An external annular seal 136 is provided between the outside of secondary riser 126 and the upper edge 34*a* of primary riser 24*a*. If desired, an internal annular seal 138 may be provided between the lower end of secondary riser 126 and flange 122, either as an alternative or a supplement to the external annular seal 136. The sensor output cable 116*a* extends from the inside to the outside of secondary riser 126 through a sealed aperture 140, and thence upwardly to surface readout equipment.

The purpose of flange or ring 122 is to assure proper vertical orientation of secondary riser 126. This purpose may alternatively be served by a plurality of generally horizontal tabs attached to the inside of primary riser 24*a*, which may be used in conjunction with top points on inner tank wall 18*a* if desired, to locate the secondary riser 126 in its proper position.

It is to be noted that the form of the invention shown in FIG. 6 does not require a secondary containment plate like plate 36 of the form shown in FIGS. 1-5. In the form of FIG. 6, secondary riser 126 and its sealing lid 132 when used effectively serve the secondary containment function of plate 36.

Looking at the left-hand side of secondary riser 126 as viewed in FIG. 6, a large aperture 142 is provided through the wall of secondary riser 126 to accommodate a bulkhead fitting generally designated 144. Fitting 144 includes a partially externally threaded sleeve 146 which extends through aperture 142, with internal and external contour washers 148 and 150, respectively, surrounding sleeve 146 and engaged flush against the respective inner and outer surfaces of secondary riser 126. Contour washers 148 and 150 are clamped in sealing engagement against the wall of secondary riser 126 and the sleeve 146 located in place by inner and outer nuts 1523 and 154, respectively, threadedly engaged over the threaded portion of sleeve 146. Alternatively, either one of the nuts 152 and 154 may be an integral external flange on the sleeve 146.

Large diameter accordion tubing 156 is engaged over and spaced about pipe 56*a*, having a cylindrical end portion 158 that is clamped about an unthreaded end portion of sleeve 146 by means of a band clamp 160. Accordion tubing 156 provides good secondary containment for pipe 56*a*, and its flexibility makes it particularly easy to install. Accordion tubing 156 may be coextensive with the length of pipe 56*a* that would otherwise be exposed, extending upwardly to surface equipment, or it may only cover a lower portion of pipe 56*a*. It is to be understood that other flexible tubing, or generally rigid tubing, may be employed in place of the accordion tubing 156.

A variation of the secondary containment for the piping is illustrated at the right-hand side of secondary riser 126 as viewed in FIG. 6. Here, a large aperture 162 is provided through secondary riser 126, and large diameter tubing 164, which may be fiberglass reinforced resin, extends through aperture 162 and is bonded and sealed to secondary riser 126 by resin bonding and sealing material 166. Tubing 164 surrounds and is spaced outwardly from pipe 58*a*, and may either be coextensive with the length of pipe 58*a* that would otherwise be exposed, extending to surface equipment, or may only cover a lower portion of pipe 58*a*.

Backfill material 168, which may be tamped sand, gravel or the like, surrounds secondary riser 126 and tubings 156 and 164, and if desired the material 168 may also fill the secondary riser 126. A concrete slab 170, such as the typical service station pad, overlies the tank secondary containment system 10*a* shown in FIG. 6, and has a servicing manway 162 therethrough which coaxially overlies risers 24*a* and 126. Typically, manway 172 will be covered by an "Alhambra" type manway cover like the sewer covers employed in streets.

The secondary containment spaces in the system 10*a* of FIG. 6 include the large secondary containment space 176 within secondary riser 126 and extending downwardly past the flange 122 and circular aperture 26*a* in outer tank wall 16*a* to inner tank wall 18*a*; secondary containment space 178 defined between pipe 56*a* on the inside and sleeve 146 and accordion tubing 156 on the outside; and secondary containment space 180 defined between pipe 58*a* on the inside and tubing 164 on the outside. For some installations, the secondary containment afforded by secondary riser 126 will be adequate without the lid 132.

Any liquid or gas which might escape from inner, primary chamber 20*a* through a pipe fitting 44*a* or 46*a*, or any liquid or gas which might escape from a joint in either of the pipes 56*a* or 58*a*, will be retained in the secondary containment spaces 176, 178, and 180. Escaped liquid will accumulate in the low region of secondary containment space 176 proximate probe 114*a* of sensor 108*a*, and escaped liquid or gas in this region will be sensed by sensor 108*a*.

As with the first form of the invention shown in FIGS. 1–5, it is preferred to cover the outside of the tank, including outer tank wall 16*a*, riser 24*a*, and the upper surface of ring 122 with a fiberglass reinforced resin coating 182 for protection against corrosion.

Figure 7:
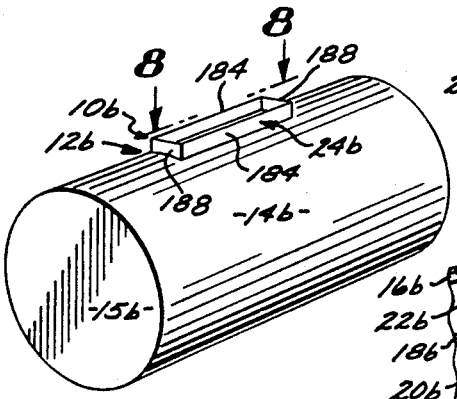
FIG. 7 is a perspective view similar to FIG. 1 illustrating a third form of the invention which has an elongated, rectangular primary riser that encompasses a generally elongated array of a plurality of pipe fittings and associated function pipes, the upwardly extending function pipes and their respective secondary containment tubes not being shown in the small view of FIG. 7.

FIGS. 7–10 illustrate another tank secondary containment system according to the invention which is generally designated 10*b*, wherein any desired number of generally longitudinally arranged pipe fittings and corresponding function pipes may be accommodated by a secondary containment system of the invention which has a generally elongated configuration. The tank secondary containment system 10*b* as illustrated in FIGS. 7–10 has five pipe fittings and corresponding function pipes, but it may be made to accommodate a large number, if desired. Five pipe fittings enable all five conventional service station functions to be employed in the single secondary containment 10*b*, including a fill fitting, a turbine fitting for fluid extraction, a gauge fitting, a vapor recovery fitting, and a vent fitting. The secondary containment system 10*b* has an elongated form which extends longitudinally along the top of the tank generally coaxial with the longitudinal axis of the tank. This general arrangement is best seen in FIG. 7, wherein tank 12*b* is shown with cylindrical body 14*b* and end closures 15*b*, secondary containment system 10*b* extending longitudinally along the top of cylindrical tank body 14*b*.

Figure 9:
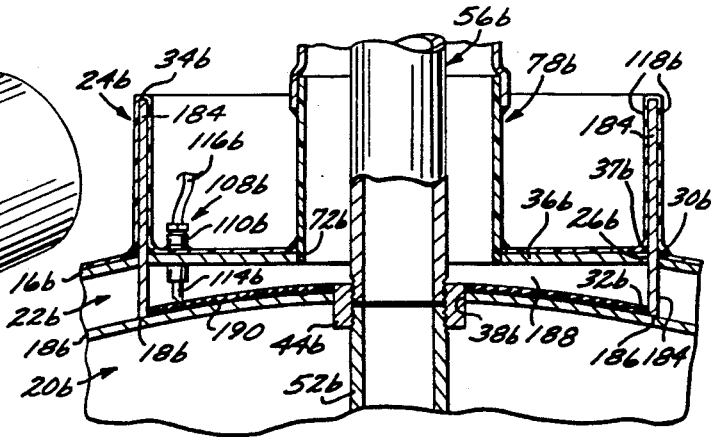
FIG. 9 is a fragmentary transverse vertical section taken on the line 9—9 in FIG. 10 which shows internal details of construction of this form of the invention.

As seen in FIG. 9, tank cylindrical body 14*b* includes outer cylindrical wall 16*b* and concentric inner cylindrical wall 18*b*, with inner, primary chamber 20*b* defined within inner wall 18*b*, and outer, secondary chamber 22*b* defined between respective outer and inner walls 16*b* and 18*b*.

The form of tank secondary containment system 10*b* shown in FIGS. 7–10 is generally the same as the form 10 shown in FIGS. 1–5 except for the elongated arrangement in the form 10*b* wherein riser 24*b* extends longitudinally along the top of cylindrical tank body 14*b*, with the pipe fittings and associated function pipes longitudinally aligned within riser 24*b*. Riser 24*b* is shown as rectangular in configuration, with straight ends, although it is to be understood that it may alternatively be oval in configuration with curved or arcuate ends. Rectangular riser 24*b* is engaged downwardly through a mating rectangular aperture 26*b*. Riser 24*b* includes a pair of elongated, parallel, vertically arranged side walls 184 which have straight lower edges 186 that fit flush against the outer surface of outer tank wall 16*b*. The side walls 184 are arranged parallel to the longitudinal axis of tank cylindrical body 14*b*. A pair of parallel, vertically arranged end walls 188 is arranged at right angles to side walls 184, end walls 188 having arcuate lower edges 190 with the same radius of curvature of the outer surface of outer tank wall 16*b*, the lower edges 186 fitting flush against outer wall 16*b*. The outer surfaces of riser 24*b* are bonded, as by a weld seam 30*b*, to the outside of outer wall 16*b* around the entire periphery of riser 24*b*, weld 30*b* providing a fluid-tight seal between riser 24*b* and outer tank wall 16*b*. The inner surfaces of riser 24*b* proximate its lower edges 186 and 190 are bonded to the outside of inner tank wall 18*b*, as by a weld seam 34*b* which extends around the entire periphery of riser 24*b* and provides a fluid-tight seal between riser 24*b* and inner tank wall 18*b*. Riser 28*b* extends upwardly from outer wall 16*b* to an upper edge 34*b*, providing a sump region within riser 24*b*.

A flat, rectangular secondary containment plate 36*b* is complementary in configuration to the rectangular inside of riser 24*b*, and is arranged horizontally within riser 24*b*. The top of secondary containment plate 36*b* is bonded, as by a weld 37b, to the inside of riser 24b around the entire periphery of plate 36b, weld 37b providing a fluid-tight seal between plate 36b and riser 24b.

Figure 8:
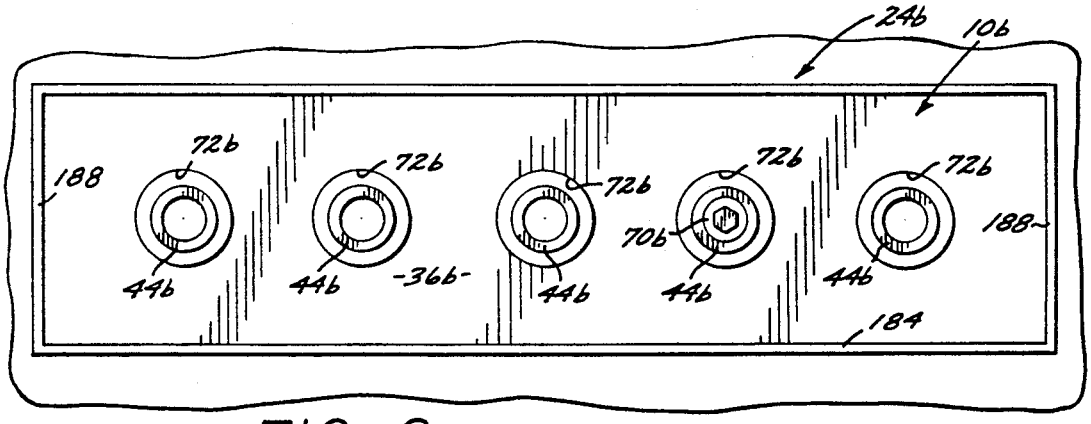
FIG. 8 is a top plan view taken on the line 8—8 in FIG. 7 showing the riser, secondary containment plate spanning the riser, and access fittings in the inner tank wall which are seen through respective apertures in the secondary containment plate.
Figure 10:
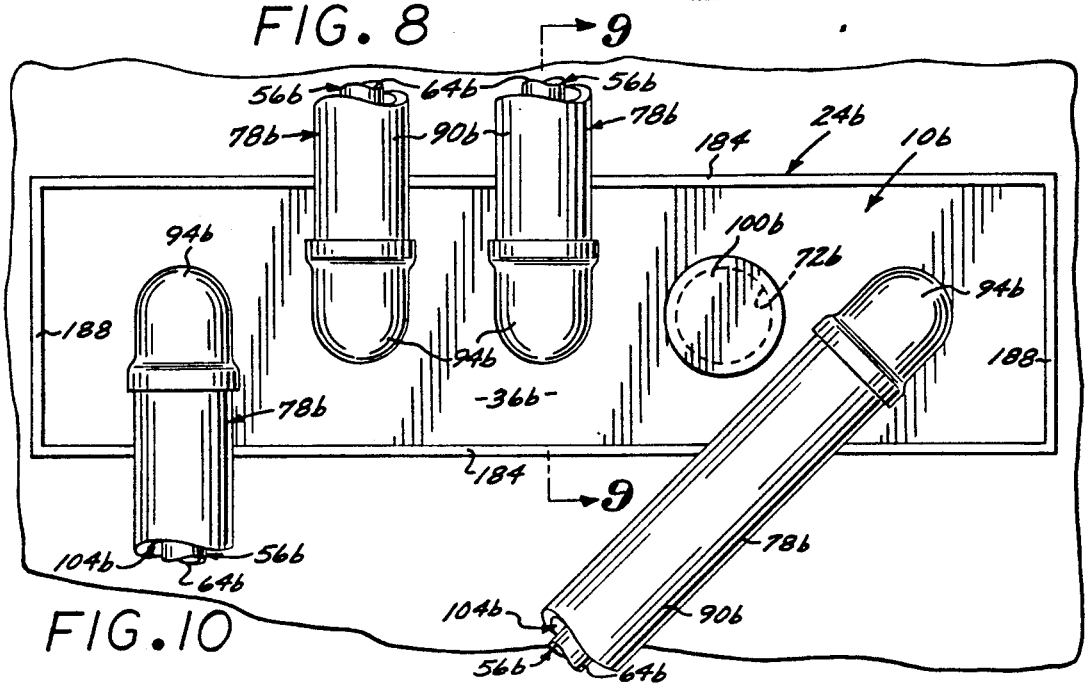
FIG. 10 is a fragmentary top plan view showing the form of the invention of FIGS. 7-9, with four of five apertures through the secondary containment plate having function pipes and surrounding secondary containment tubes, and the fifth containment plate aperture being covered.

Five regularly longitudinally spaced holes 38b through inner tank wall 18b accommodate five respective pipe fittings 44b which are secured as by fluid-tight welds. Riser 24b generally registers with but is somewhat larger than the array of pipe fittings 44b. A pipe 52b is threadedly coupled to fitting 44b and extends downwardly into the inner, primary tank chamber 20b as seen in FIG. 9. Similar downwardly extending pipes 52b may be threadedly coupled to any of the other pipe fittings 44b. Upwardly extending function pipes 56b may be threadedly coupled to any of the five pipe fittings 44b. In FIGS. 9 and 10, four of the upwardly extending function pipes 56b are threadedly coupled to four respective pipe fittings 44b, and these are shown in FIG. 10 extending in various azimuthal directions leading to different surface locations. Each of the function pipes 56b has an upwardly extending section 60b and a horizontally extending section 64b joined together by an elbow section (not shown), pipes 56b being assembled in the same manner as pipes 56 and 58 shown in FIGS. 1 and 2. The second pipe fitting 44b from the right as viewed in FIGS. 8 and 10 is shown not to be in use for a function pipe, and is therefore sealed with a plug 70b.

Five large apertures 72b extend through plate 36b in axial alignment or generally registering with the respective pipe fittings 44b. Four of these large apertures 72b have secondary containment tubes 78b fitted and sealed thereto as best seen in FIG. 9. Secondary containment tubes 78b are of the same type as secondary containment tubes 78 and 80 shown in FIGS. 1-4, including upwardly extending sections 82b affixed and sealed to plate 36bat annular attachment seals 86b, horizontally extending sections 90b, and connecting elbow sections 94b. Seals 98b are provided at the attachments between the sections of secondary containment tubes 78b. Large aperture 72b which overlies pipe fitting 44b having plug 70b therein is sealed off by means of cover disk 100b which is fastened to plate 36b by an annular seal.

Secondary containment for the system of FIGS. 7-10 is the same as secondary containment for the system of FIGS. 1-5, except for the elongated construction of riser 24b and plate 36b and the elongated arrangement of the pipe fittings 44b and pipes 56b to be contained. Thus, secondary containment space 102b is defined within riser 24b between its sides 184 and ends 188, inner tank wall 18b, and secondary containment plate 36b; and secondary containment spaces 104b are defined between each of the function pipes 56b and its respective surrounding secondary containment tube 78b. Liquid which might escape from inner, primary chamber 20b through a pipe fitting 44b, or which might escape from a joint in one of the function pipes 56b, will drain down to a lowermost zone in the secondary containment space 102b where it will be sensed by a fluid sensor 108b. Fluid sensor 108b is preferably of the type which will sense either a liquid fluid or a gaseous fluid that would be the vapor of a liquid contained in the inner, primary chamber 20b of tank 12b. Where liquid fuels are to be contained in inner, primary chamber 20b, preferably sensor 108b will be sensitive to the presence of both hydrocarbon liquid and hydrocarbon gas from the hydrocarbon liquid contained in the inner, primary chamber 20b. Sensor 108b includes a body 110b which extends through an aperture in plate 36b and is sealed to plate 36b, with a probe 114b extending downwardly to a lowermost zone in secondary containment space 102b and a sensor output cable 116b which extends to surface readout equipment. A plurality of the sensors 180b may be employed.

As with the other forms of the invention, the form shown in FIGS. 7-10 also preferably has a corrosion resistant fiberglass reinforced coating 118b covering exposed metal parts, including the outside of outer tank wall 16b, both sides and the upper edge 34b of riser 24b, the upper surface of plate 36b, and welds 30b and 37b.

Figure 11:
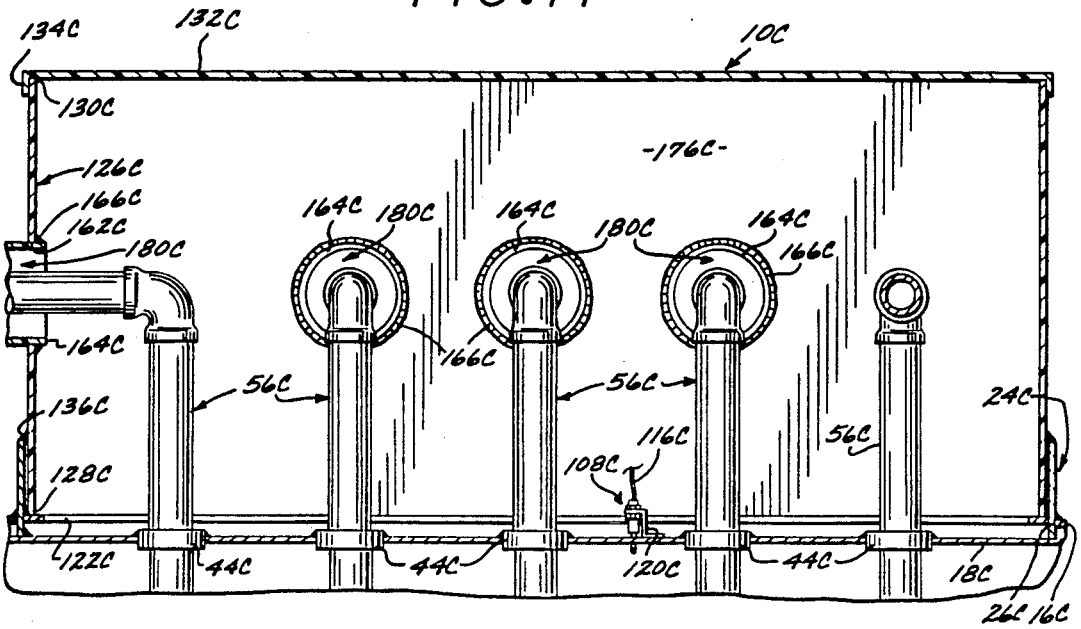
FIG. 11 is a fragmentary, longitudinal, vertical sectional view of a fourth form of the invention, which is an elongated, axial form like that shown in FIGS. 7-10, but with a large secondary riser like the secondary riser of FIG. 6 fitting within the primary riser and covering the entire longitudinal array of pipe fittings and lower portions of respective function pipes.

FIG. 11 illustrates another form of the present invention which combines the advantageous features of the form shown in FIG. 6 and the form shown in FIGS. 7-10. Thus, the embodiment shown in FIG. 11 has the advantage of a secondary riser providing part of the secondary containment space which affords convenient access for servicing of pipe fittings, connections and associated equipment located proximate the top of the tank, while at the same time enabling an elongated array of pipe fittings and associated function or service pipes to be arranged along the top of the tank.

The tank secondary containment system illustrated in FIG. 11 is generally designated 10c, and is embodied at the top of a tank having respective outer and inner cylindrical walls 16c and 18c. Elongated cylindrical riser 24c is similar to riser 24b of FIGS. 7-10, being disposed down through rectangular aperture 26c in outer tank wall 16c. The lower edge of riser 24crests flush against the upper surface of inner wall 18c, and riser 24c is bonded and peripherally sealed to both outer wall 16c and inner wall 18c in the same manner that the riser is bonded to both tank walls in the form shown in FIGS. 7-10. A flat, horizontal inwardly directed flange 122c extends peripherally inwardly from rectangular riser 24c, being bonded to riser 24a as by peripheral weld 124c. Flange 122c is the rectangular counterpart of flange 122 of FIG. 6, and flange 122c may be replaced by tabs as described above for the flange 122.

Secondary riser 126c, which may be made of fiberglass reinforced resin, is tubular with a rectangular horizontal cross-section that is generally complementary to the inner periphery of primary riser 24c. The lower portion of secondary riser 126c nests inside primary riser 24c and has its lower edge 128c seated against the upper surface of flange 122c for proper vertical orientation of secondary riser 126c. Secondary riser 126c may extend to an upper edge 130c on the order of about three feet above outer tank wall 16c. Secondary riser 126c may be covered by a complementary removable lid 132c which has a down-turned peripheral flange 134c that seals off the top of secondary riser 126c. External peripheral seal 136c of suitable resin or other sealing material seals secondary riser 126c to the upper edge of primary riser 24c around its entire periphery.

Five regularly spaced, aligned pipe fittings 44c are longitudinally arranged within riser 24c, and five respective function or service pipes 56c are threadedly connected to fittings 44c and extend upwardly and laterally to surface equipment. Fluid sensor 108c is mounted on a suitable bracket 120c so as to sense a lowermost location within primary riser 24c, and sensor cable 116c passes through a sealed aperture 140c in secondary riser 126c that extends to surface readout equipment.

Five large apertures 162c are provided through the side walls of rectangular secondary riser 126c, and the five respective function or service pipes 56c extend through these large apertures 162c. Large diameter tubing 164c is attached to secondary riser 126c at each of the apertures 162c by a peripheral bond 166c which serves as a fluid-tight seal. Each of the tubes 164c surrounds a respective pipe 56c from secondary riser 126c upwardly to a desired extent, which may be all of the way to surface equipment if desired. While tubing 164c is illustrated as the type of tubing illustrated at the right-hand side of FIG. 6, which may be rigid fiberglass reinforced resin tubing, it is to be understood that tubing 164c may be flexible, or it may be flexible accordion-type tubing like the tubing 156 shown at the left-hand side of FIG. 6, which may be connected to secondary riser 126c by a bulkhead fitting.

The secondary containment system 10c of FIG. 11 will be seen to provide service access to all of the pipe fittings 44c and associated pipes 56c and related equipment immediately above the tank simply by temporarily removing secondary riser lid 132c. With lid 132cin place, full secondary containment of the five pipe fittings 44c, associated pipes 56c, and any related equipment is afforded in secondary containment space 176c within secondary riser 126c, and within secondary containment space 180c between each of the large diameter tubes 164c and the respective pipe 56c contained therein. For some installations, the secondary cntainment afforded by secondary riser 126c will be adequate without the lid 132c.

Figure 12:
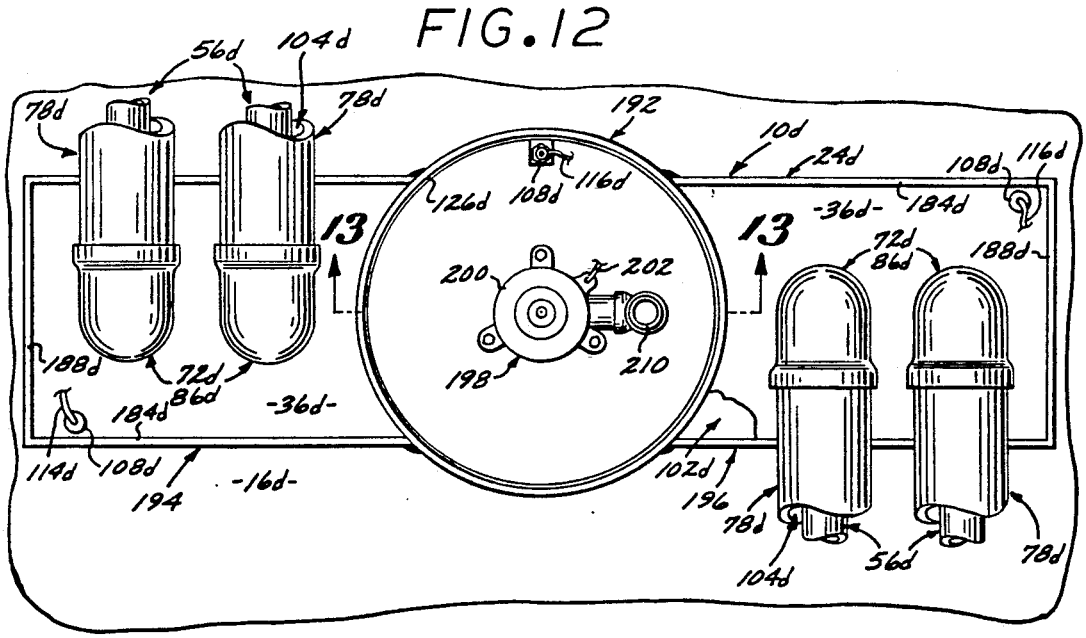
FIG. 12 is a fragmentary top plan view, with a small portion of a secondary containment plate broken away, showing a fifth form of the invention which combines features of the second form of the invention shown in FIG. 6 and the third form of the invention shown in FIGS. 7-10, with a longitudinal array of pipe fittings, a center one of which has turbine pump equipment associated therewith and is enshrouded by a large secondary riser like that seen in FIG. 6; and end ones of the pipe fittings covered by secondary containment plates, with function pipes and surrounding secondary containment tubes like those seen in the from of the invention shown in FIGS. 7-10.
Figure 13:
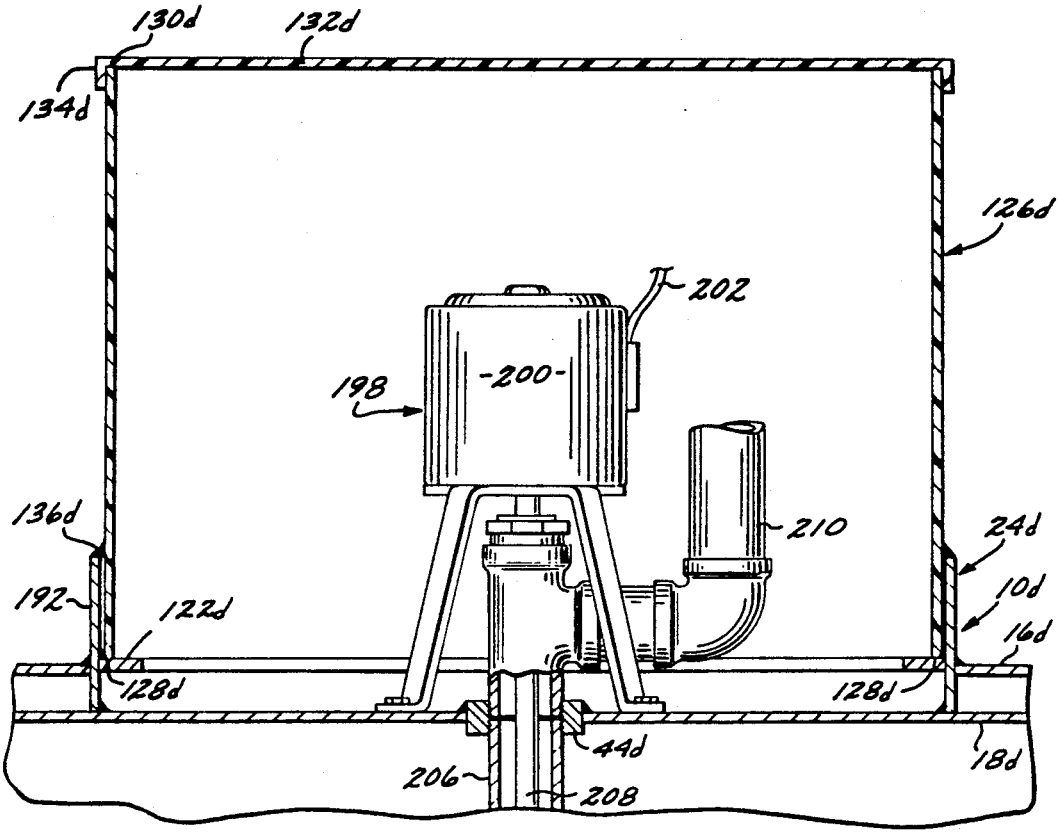
FIG. 13 is a fragmentary longitudinal, vertical section, partly in elevation, taken on the line 13—13 in FIG. 12.

The form of the invention illustrated in FIGS. 12 and 13 combines the features of all three forms shown in FIGS. 1-5, FIG. 6, and FIGS. 7-10. The tank secondary containment system shown in FIGS. 12 and 13 is generally designated 10d, and it provides the secondary riser-type of secondary containment of FIG. 6 for one particular pipe fitting and associated function pipe and related equipment, while it provides the coaxial tubular-type secondary containment of FIGS. 1-5 for a plurality of additional pipe fittings and associated pipes, all of the fittings and pipes being axially aligned along the top of the tank in the manner of the form shown in FIGS. 7-10.

The secondary containment system 10d of FIGS. 12 and 13 is shown applied to a double wall tank having outer and inner cylindrical walls 16d and 18d, respectively. An elongated primary riser axially arranged along the top of the tank is generally designated 24d, and has three discrete sections, a central circular cylindrical section 192, and a pair of generally rectangular sections 194 and 196 extending from central section 192 axially toward opposite ends of the tank. The central ends of the generally rectangular sections 194 and 196 are defined by portions of the cylindrical wall of central section 192, the sides of sections 194 and 196 are defined by vertical, parallel, longitudinally arranged side walls 184d, and the outer ends of sections 194 and 196 are defined by transverse vertical end walls 188d.

Each of the end primary riser sections 194 and 196 has a horizontal secondary containment plate 36d mounted therein which is peripherally bonded and sealed at its inner end to central riser section 192, at its sides to side walls 184d, and at its outer ends to end walls 188d. Two axially spaced large apertures 72d are provided through each of the secondary containment plates 36d, although any number of such large apertures 72d may be provided through each of the plates 36d. Five axially aligned pipe fittings 44d are mounted in inner tank wall 18d, one of the fittings 44d being mounted centrally within central cylindrical riser section 192, and two of the fittings being mounted under and aligned or in registry with the respective two large apertures 72d through each secondary containment plate 36d. It is to be understood that if the number of large apertures 72d through each plate 36d is other than two, there will be a corresponding respective number of pipe fittings 44d under such apertures 72d.

Two function pipes 56d are connected to the respective pipe fittings 44d in each of the generally rectangular end sections 194 and 196 of primary riser 24d, and a large secondary containment tube 78d surrounds each of the pipes 56d and is bonded and sealed to its respective secondary containment plate 36d, secondary containment tubes 78d being arranged and serving the same function as secondary containment tubes 78 and 80 of FIGS. 1-5 and 78b of FIGS. 7-10. Thus, a secondary containment space 102d is defined between each of the two secondary containment plates 36d and inner tank wall 18d, and secondary containment spaces 104d are defined between each of the large secondary containment tubes 78dand the respective pipe 56d which it surrounds. A sensor 108d may be mounted on each of the two secondary containment plates 36d for sensing at low regions in the secondary containment spaces 102d. Sensors 108d have cables 116d which extend to surface readout equipment.

A cylindrical secondary riser 126d has its lower annular portion fitted inside of the central cylindrical section 192 of primary riser 24d, with its lower edge 128d seated against flange 122d (or alternative tabs) attached to the inside of primary riser section 192. Cylindrical secondary riser 126d may be the same as riser 126 shown in FIG. 6 and described in detail in connection therewith. Secondary riser 126d extends upwardly to an upper annular edge 130d and may be covered by a removable lid 132d which seats against upper edge 130d and has a down-turned sealing flange 134d. An external annular peripheral seal 136d is provided between the outside of secondary riser 126d and cylindrical primary riser section 192.

As indicated above, a turbine pump for fuel extraction is the most likely equipment on the tank to require servicing. Accordingly, secondary riser 126d with its removable lid 132d provide convenient access for a workman to service the external part of a turbine pump generally designated 198 which is fitted to the pipe fitting 44d that is centrally located within primary riser section 192 and secondary riser 126d. Turbine pump 198 has an external drive motor 200 with an electric power supply cable 202 which extends upwardly through a sealed aperture in secondary riser 126d to a surface connection. A fuel pickup pipe 206 extends downwardly from the respective pipe fitting 44d, and a turbine impeller drive rod 208 extends from motor 200 down through pipe 206 to a location near the bottom of the tank. A fuel delivery pipe 210 extends upwardly from this respective pipe fitting 44d and through a large aperture (not shown) in the wall of secondary riser 126d to surface equipment.

The large aperture in the wall of secondary riser 126d through which fuel delivery pipe 210 extends may correspond to either of the large apertures 142 or 162 of FIG. 6. Outside of secondary riser 126d the pipe 210 is covered by a secondary containment tube (not shown) corresponding to either tube 156 or tube 164 of FIG. 6, connected to secondary riser 126d by a bulkhead fitting like fitting 144 of FIG. 6 or a bond like 166 of FIG. 6. Thus, for turbine pump 198, there is a large secondary containment space 176d within secondary riser 126d and primary riser section 192, and also an elongated secondary containment space between fuel delivery pipe 210 and its covering secondary containment tube.

One or more fluid sensors 108*d* are bracketed to inner tank wall 18*d*, or alternatively to flange 122*d*, for sensing one or more lowermost regions within secondary containment space 176*d*. Each such sensor 108*d* has a sensor cable 116*d* which extends out through a sealed aperture in secondary riser 126*d* and thence to surface readout equipment.

The sealed apertures in the wall of secondary riser 126 and through which sensor cable 116*d*and the pump power supply cable 202 extend may each be like the sealed aperture 140 of FIG. 6.

Figure 14:
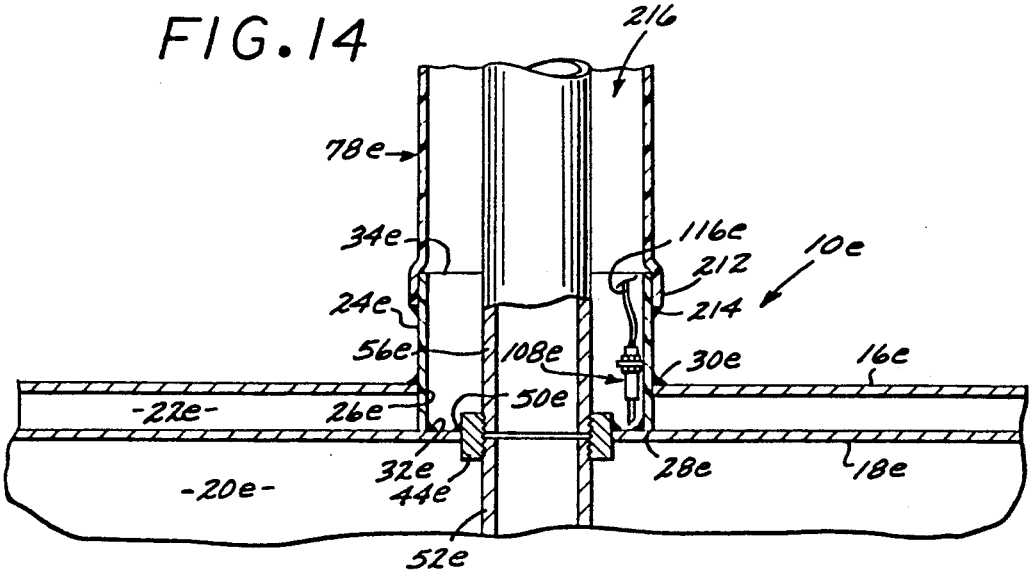
FIG. 14 is a fragmentary vertical section view, partly in elevation, showing a sixth form of the invention wherein an individual pipe fitting and associated function pipe are secondarily contained within an individual respective riser and secondary containment tube.

FIG. 14 illustrates a further form of the present invention in which the secondary containment is applied individually with respect to each of the access pipe fittings. This type of tank secondary containment system is generally designated 10*e*, and is illustrated in FIG. 14 with respect to a single one of the access pipe fittings. Here the secondary containment system 10*e* is shown applied to a double wall tank having concentric outer and inner cylindrical walls 16*e* and 18*e*, respectively. Inner cylindrical wall 18*e* defines therein inner, primary tank chamber 20*e*, while outer peripheral, secondary chamber 22*e* is defined in part between outer and inner walls 16*e* and 18*e*, respectively.

As with the other illustrated forms of the invention, access pipe fitting 44*e* is mounted on inner cylindrical tank wall 18*e* only, being welded thereto by an external weld 50*e*. A pipe 52*e* is shown downwardly extending from fitting 44*e*, and upwardly extending function pipe 56*e* extends upwardly from engagement with fitting 44*e*.

A small cylindrical riser 24*e* extends downwardly through a circular aperture 26*e* in outer tank wall 16*e*, with the lower edge 28*e* of riser 24*e* slightly contoured so as to seat flush on the outer surface of inner tank wall 18*e*. The outside of riser 24*e* is attached and sealed to the outside of outer tank wall 16*e* by a bond 30*e*; while the inside of riser 24*e* is attached and sealed to the outside of inner tank wall 18*e* by a bond 32*e*. Riser 24*e* has an upper annular edge 34*e*, riser 24*e* preferably extending upwardly from the outer cylindrical tank wall 16*e* for convenient attachment of secondary containment tubing to riser 24*e*. However, riser 24*e* is preferably relatively short in the axial, vertical direction for easy access from above for application of the inner bond 32*e*. Riser 24*e* may be made of metal, in which case bonds 30*e* and 32*e* may be welds; or riser 24*e* may be made of fiberglass reinforced resin, in which case bonds 30*e* and 32*e* will be resin bonds.

As with the other forms of the invention, the secondary containment system 10*e* shown in FIG. 14 permits all bonds to be applied from the outside of the tank. Most conveniently, the access fitting 44*e* will be welded by weld 50*e* to inner tank wall 18*e* through the circular aperture 26*e* in outer wall 16*e* before installation of riser 24*e*. Then, riser 24*e* will be inserted down through aperture 26*e* and bonded from the outside of the tank to outer and inner walls 16*e* and 18*e*, respectively, by bonds 30*e* and 32*e*, respectively. Riser 24*e* is coaxial about pipe fitting 44*e* and pipe 56*e*, and is sufficiently larger in diameter than fitting 44*e* to provide adequate room for application of both the fitting weld 50*e* and the riser bond 52*e*.

Secondary containment tube 58*e*, which may be made of fiberglass reinforced resin, has an enlarged collar fitting 212 formed on its lower end that fits over the exposed upper end portion of riser 24*e* and is peripherally attached and sealed to riser 24*e* by bond 214, which may be a resin bond. Secondary containment tube 78*e* extends upwardly coaxially about and coextensively with function pipe 56*e* to surface equipment.

In the form of the invention shown in FIG. 14, the secondary containment space is generally designated 216, and it is uninterrupted, extending upwardly, from inner tank wall 18*e* and fitting 44*e* at its lower end, being defined in its lower end portion in the annulus between riser 24*e* and pipe 56*e*, and then between secondary containment tube 78*e* and pipe 56*e* coextensively with the lengths of tube 78*e* and pipe 56*e* to surface equipment. It is to be understood that, as with the other forms of the invention, the secondary containment tubing and function pipe may include various straight and curved sections as required for directing them to the desired surface equipment.

A fluid sensor generally designated 108*e* is located within the annulus between riser 24*e* and pipe 56*e*, for sensing a low point within this annulus. Sensor 108*e* may be bracketed to the wall of riser 24*e*. Sensor 108*e* has output cable 116*e* which is shown broken off, but which may extend upwardly to surface equipment through the space between secondary containment tube 78*e* and pipe 56*e*; or alternatively, may extend out through a sealed aperture (not shown) in tube 78*e* and thence externally of tube 78*e* to surface equipment.

Fabrication of all forms of the invention shown and described in detail herein is greatly facilitated by the fact that the structural arrangements are such that all bonds and seals can be made from outside of the tanks, and none need be made from within the tanks. Thus, in the form of the invention shown in FIGS. 1–5, riser 24 is bonded from the outside of tank 12 to inner tank wall 18 by bond 32 and outer tank wall 16 by bond 30, and the three pipe fittings 44, 46 and 48 are also bonded to inner tank wall 18 from the outside. Then after such bonding is completed, secondary containment plate 36 is peripherally bonded to riser 24 from the outside by bond 37. Then secondary containment tubes 78 and 80 are bonded to plate 36, also from the outside. Similarly, in the form of the invention shown in FIG. 6, riser 24*a* is bonded from the outside to inner tank 18*a* by bond 32*a* and to outer tank 16*a* by bond 30*a*, and pipe fittings 44*a* and 46*a* are bonded from the outside to inner tank wall 18*a* by bonds 50*a*. Annular flange or ring 122 is bonded to riser 24*a* from about by bond 124. Secondary riser 126 is bonded and sealed to primary riser 24*a* from above at upper seal 136, and if desired at lower seal 138. Bulkhead fitting 144 is readily assemblable on secondary riser 126 from above, as is the connection of accordion tubing 156 to bulkhead fitting 144; and also tubing 164 is attached and sealed to secondary riser 126 from above. Similarly, all attachments in the forms of the invention shown in FIGS. 7–10 and 11–14 may be provided or accomplished from above, in the same manner as those done in the forms of the invention shown in FIGS. 1–5 and FIG. 6. All of the sensors are arranged to be installed from above.

The secondary containment tubes of the various forms of the invention will in some cases extend coextensively with their respective function pipes to surface equipment, where the annulus between each tube and its respective pipe will normally be sealed. In other cases, the secondary containment tubes may only be required to extend along lower portions of the function pipes. In such case, the annulus between each tube and its respective function pipe will still normally be sealed proximate the upper end of the tube. In some cases, the upper ends of the secondary containment tubes may not be required to be sealed.

While the present invention has been shown and described in detail with respect to circular and rectangular configurations applied to specific arrays of access pipe fittings, it is to be understood that other configurations of the invention may be applied to any desired arrays of fittings within the scope of the invention.

In each of the forms of the invention illustrated herein in connection with a double wall tank, the primary riser has been shown extending down through a large aperture in the outer wall to the inner wall and being bonded to both the outer wall and the inner wall with bonds which provide peripheral seals. However, the peripheral seal between the riser and the outer tank wall is the only one that is important to afford secondary containment. If desired, the riser need not be sealed to the inner tank wall, in which case liquid leaking from a pipe fitting or connection will drain from the riser into the outer tank chamber, which is the interstitial space between the outer and inner tank walls, and be sensed by sensor means conventionally located in this space. Thus, if desired, this mode of operation may be deliberately utilized by connecting and sealing the riser only to the outer tank wall and not bringing the riser down through the space between the tank to the inner tank wall, leaving the space around the pipe fitting which are served by the riser open between the two tank walls. This variation of the invention will still have the pipe fittings mounted only on the inner tank wall. In all other respects the system of the invention will be the same as shown and described in detail above.

Another alternative arrangement of the invention as applied to a double wall tank is to not have a riser aperture through the outer tank wall, and to bond and seal the primary riser on the outside of the outer tank wall. In this case, the pipe fittings within the riser are mounted in and bonded to both of the tank walls, and can be installed from the outside of the tank by providing an oversize hole in the outer tank which enables bonding of the fittings to the inner wall from the outside, and then filling in the oversize space and bonding the fittings to the outer wall. Again, in all other respect the system of the invention will be the same as shown and described in detail above.

The system of the invention may be applied to any single wall tank in the same way as described in the immediately preceding paragraph for a double wall tank, the primary riser being bonded and sealed to the outside of the single wall of the tank. In this case, the pipe fittings within the riser are mounted in and bonded to the single wall of the tank, which can be accomplished from the outside of the tank. Again, in all other respects the system of the invention will be the same as shown and described in detail above.

While a fiberglass-reinforced coating such as "Plasteel" has been shown on the forms of the invention illustrated in FIGS. 1–5, 6, and 7–10, but has not been shown on the forms illustrated in FIGS. 11, 12–13, and 14, it is to be understood that such an anticorrosion coating is optional, and may be included or omitted from any of the forms of the invention.

While the present invention has been described with reference to presently preferred embodiments, it is to be understood that various modifications or alterations may be made by those skilled in the art without departing from the scope and spirit of the invention as set forth in the appended claims.

I claim:

1. In a fluid storage tank having fluid containment wall means, a secondary fluid containment system which comprises:

said tank being of generally cylindrical configuration with its said wall means comprising a generally cylindrical portion and end closures, said tank being adapted to be arranged with its cylindrical axis disposed generally horizontally;

access pipe fitting means on said cylindrical portion of said wall means proximate the top thereof providing fluid access between the inside and outside of said wall means;

said fitting means comprising a plurality of pipe fittings proximate the top of said generally cylindrical wall portion and arranged in a generally elongated array aligned generally parallel to said cylindrical axis;

function pipe means comprising a plurality of function pipes connected to the respective said fittings and extending generally upwardly from said fittings outside of said wall means;

generally tubular secondary containment cover means extending generally upwardly from said wall means and over at least a lower portion of said pipe means, said cover means being connected and sealed to said wall means;

said cover means generally surrounding said fittings and said lower portion of said pipe means and being sized so as to provide a secondary fluid containment space within said cover means between said cover means and said fitting means and said lower portion of said pipe means; and a lower portion of said cover means generally surrounding said fittings being elongated in the general longitudinal direction of said array.

2. A secondary fluid containment system as defined in claim 1, wherein said lower portion of said cover means is generally rectangular in configuration.

3. In a fluid storage tank having fluid containment wall means, a secondary fluid containment system which comprises:

access pipe fitting means on an upper portion of said wall means providing fluid access between the inside and outside of said wall means;

function pipe means connected to said fitting means and extending generally upwardly from said fitting means outside of said wall means;

generally tubular secondary containment cover means extending generally upwardly from said wall means and over at least a lower portion of said pipe means, said cover means being connected and sealed to said wall means;

said cover means generally surrounding said fitting means and said portion of said pipe means and being sized so as to provide secondary fluid containment space within said cover means between said cover means and said fitting means and said portion of said pipe means;

said secondary containment cover means comprising generally tubular riser means connected and sealed to said wall means, said riser means generally surrounding said fitting means; and secondary containment tube means connected and sealed to said riser means and extending in covering relationship over at least part of said lower portion of said pipe means.

4. A secondary fluid containment system as defined in claim 3, wherein said connection and sealing of said tube means to said riser means comprises plate means extending across the inside of said riser means and peripherally connected and sealed to said riser means;

said plate means having aperture means therethrough generally registering with said fitting means, said tube means being connected and sealed to said plate means generally in registry with said aperture means and extending generally upwardly from said plate means.

5. A secondary fluid containment system as defined in claim 4, wherein said fitting means comprises a plurality of pipe fittings, said aperture means comprises a like plurality of apertures generally registering with the respective said fittings, and said tube means comprises a like plurality of secondary containment tubes connected and sealed to said plate means generally in registry with respective said apertures.

6. A secondary fluid containment system as defined in claim 3, wherein said riser means is generally circular in configuration and said plate means is generally disk-shaped.

7. A secondary fluid containment system as defined in claim 5, wherein said pipe fittings and said apertures are arranged in generally elongated arrays.

8. A secondary fluid containment system as defined in claim 7, wherein said riser means and said plate means are elongated in the general longitudinal direction of said arrays.

9. A secondary fluid containment system as defined in claim 8, wherein said riser means and said plate means are generally rectangular in configuration.

10. A secondary fluid containment system as defined in claim 4, which comprises fluid sensor means under said plate means proximate a lowermost point in said secondary containment space.

11. A secondary fluid containment system as defined in claim 3, which comprises aperture means through the wall of said riser means, and wherein said secondary containment tube means is connected and sealed to said riser means generally in registry with said aperture means, secondary containment space being defined within said riser means.

12. A secondary fluid containment system as defined in claim 11, wherein said secondary containment tube means is directly bonded to said riser means.

13. A secondary fluid containment system as defined in claim 11, wherein said secondary containment tube means is connected to said riser means by bulkhead fitting means.

14. A secondary fluid containment system as defined in claim 11, wherein said secondary containment tube means comprises substantially rigid tubing.

15. A secondary fluid containment system as defined in claim 11, wherein said secondary containment tube means comprises flexible tubing.

16. A secondary fluid containment system as defined in claim 15, wherein said secondary containment tube means comprises accordion-type tubing.

17. A secondary fluid containment system as defined in claim 11, wherein said riser means has cover means thereon.

18. A secondary fluid containment system as defined in claim 3, wherein said riser means comprises a plurality of riser sections, said fitting means comprises a plurality of pipe fittings, and said tube means comprises a like plurality of secondary containment tubes;

plate means extending across the inside of at least one of said riser sections and peripherally connected and sealed to such riser section;

said plate means having aperture means generally registering with at least one of said pipe fittings, at least one of said tubes being connected and sealed to said plate means generally in registry with said aperture means and extending generally upwardly from said plate means;

second aperture means through the wall of another of said riser sections, and at least one other of said tubes being connected and sealed to such riser section generally in registry with said second aperture, secondary containment space being defined within such riser section.

19. In a fluid storage tank having primary fluid containment wall means, a secondary fluid containment system which comprises:

access pipe fitting means on an upper portion of said wall means providing fluid access between the inside and outside of said wall means;

function pipe means connected to said fitting means and extending generally upwardly from said fitting means outside of said wall means;

generally tubular secondary containment cover means extending generally upwardly from said wall means and over at least a lower portion of said pipe means, said cover means being connected and sealed to said wall means;

said cover means generally surrounding said fitting means and said portion of said pipe means and being sized so as to provide secondary fluid containment space within said cover means between said cover means, and said fitting means and said portion of said pipe means;

said secondary containment cover means comprising generally tubular riser means connected and sealed to said wall means, said riser means generally surrounding said fitting means;

secondary containment tube means connected and sealed to said riser means and extending in covering relationship over at least part of said lower portion of said pipe means;

aperture means through the wall of said riser means, said secondary containment tube means being connected and sealed to said riser means generally in registry with said aperture means, secondary containment space being defined within said tube means;

said fitting means comprising a plurality of pipe fittings, said aperture means comprising a like plurality of apertures through the wall of said riser means, and said tube means comprising a like plurality of secondary containment tubes connected and sealed to said riser means generally in registry with respective said apertures; and said pipe fittings being arranged in a generally elongated array, and said riser means being elongated in the general longitudinal direction of said array.

20. In a fluid storage tank having primary fluid containment wall means, a secondary fluid containment system which comprises:

access pipe fitting means on an upper portion of said wall means providing fluid access between the inside and outside of said wall means;

function pipe means connected to said fitting means and extending generally upwardly from said fitting means outside of said wall means;

generally tubular secondary containment cover means extending generally upwardly from said wall means and over at least a lower portion of said pipe means, said cover means being connected and sealed to said wall means;

said cover means generally surrounding said fitting means and said portion of said pipe means and being sized so as to provide secondary fluid containment space within said cover means between said cover means, and said fitting means and said portion of said pipe means;

said secondary containment cover means comprising generally tubular riser means connected and sealed to said wall means, said riser means generally surrounding said fitting means;

secondary containment tube means connected and sealed to said riser means and extending in covering relationship over at least part of said lower portion of said pipe means;

aperture means through the wall of said riser means, said secondary containment tube means being connected and sealed to said riser means generally in registry with said aperture means, secondary containment space being defined within said tube means;

said fitting means comprising a plurality of pipe fittings, said aperture means comprising a like plurality of apertures through the wall of said riser means, and said tube means comprising a like plurality of secondary containment tubes connected and sealed to said riser means generally in registry with respective said apertures; and said riser means being generally rectangular in configuration.

* * * * *